US007153246B2

(12) United States Patent
Koscielny et al.

(10) Patent No.: US 7,153,246 B2
(45) Date of Patent: Dec. 26, 2006

(54) NEUROLOGICAL MOTOR THERAPY SUIT

(76) Inventors: Richard Koscielny, 3054 Moon Lake Dr., West Bloomfield, MI (US) 48323; Izabela Koscielny, 3054 Moon Lake Dr., West Bloomfield, MI (US) 48323

( * ) Notice: Subject to any disclaimer, the term of this patent is extended or adjusted under 35 U.S.C. 154(b) by 459 days.

(21) Appl. No.: 10/269,587

(22) Filed: Oct. 11, 2002

(65) Prior Publication Data

US 2003/0092545 A1 May 15, 2003

Related U.S. Application Data

(60) Provisional application No. 60/337,657, filed on Nov. 13, 2001.

(51) Int. Cl.
*A63B 21/00* (2006.01)

(52) U.S. Cl. ..... 482/121; 482/124

(58) Field of Classification Search ..... 482/124–126, 482/121, 69; 2/69, 102, 425; 602/19
See application file for complete search history.

(56) References Cited

U.S. PATENT DOCUMENTS

| | | | | | |
|---|---|---|---|---|---|
| 2,613,932 | A | | 10/1952 | Manners | 272/80 |
| 3,162,442 | A | | 12/1964 | Karlik | 272/80 |
| 3,295,517 | A | | 1/1967 | Stevens | 128/78 |
| 4,065,814 | A | | 1/1978 | Fox | 2/79 |
| 4,658,442 | A | * | 4/1987 | Tomlinson et al. | 2/94 |
| 4,910,802 | A | | 3/1990 | Malloy | 2/69 |
| 5,062,642 | A | | 11/1991 | Berry et al. | 273/183 |
| 5,144,694 | A | * | 9/1992 | Conrad Da oud et al. | 2/69 |
| 5,186,701 | A | | 2/1993 | Wilkinson | 482/125 |
| 5,306,222 | A | | 4/1994 | Wilkinson | 482/124 |
| 5,308,305 | A | | 5/1994 | Romney | 482/124 |
| 5,331,683 | A | * | 7/1994 | Stone et al. | 2/2.5 |
| 5,336,139 | A | | 8/1994 | Miller | 482/10 |
| 5,373,582 | A | * | 12/1994 | Dragone et al. | 2/2.5 |
| 5,411,493 | A | * | 5/1995 | Rodriguez | 604/290 |
| 5,507,707 | A | | 4/1996 | Miller | 482/10 |
| 5,555,562 | A | | 9/1996 | Holt et al. | 2/69 |
| 5,570,472 | A | | 11/1996 | Dicker | 2/69 |
| 5,647,827 | A | | 7/1997 | Gutkowski et al. | 482/124 |

(Continued)

FOREIGN PATENT DOCUMENTS

RU 49246 * 8/2001

OTHER PUBLICATIONS

Eur-Med Brochure ! and 2 Adeli Suit Tele 513 7419696.*

(Continued)

*Primary Examiner*—Jerome Donnelly
(74) *Attorney, Agent, or Firm*—Gifford, Krass, Groh, Sprinkle, Anderson & Citkowski, P.C.

(57) ABSTRACT

A neurological motor therapy suit includes a vest which is snugly, but removably, secured around the shoulders and chest of a patient. The vest completely encircles a portion of the upper torso of the patient and is constructed of a substantially non-elastic material. A pant garment is detachably secured to the patient so that the pant garment extends around both the hips of the patient as well as the upper portion of each thigh. The pant garment is also constructed of a substantially non-elastic material. A plurality of the elastic bands extend between and interconnect the vest and the pant garment. Optionally, the therapy suit includes a cap removably secured to the head of the patient, knee supports removably secured to the knees of the patient, and/or shoe supports. Elastic bands extend between the cap, knee support and shoe supports to other parts of the therapy suit.

4 Claims, 3 Drawing Sheets

U.S. PATENT DOCUMENTS

| | | | | | |
|---|---|---|---|---|---|
| D385,385 | S | | 10/1997 | Dicker | D2/731 |
| 5,700,231 | A | | 12/1997 | Wilkinson | 482/124 |
| 5,716,307 | A | | 2/1998 | Vadher | 482/125 |
| 5,720,042 | A | | 2/1998 | Wilkinson | 2/69 |
| 5,752,900 | A | | 5/1998 | Holland, Jr. | 482/124 |
| 5,778,452 | A | | 7/1998 | Dicker et al. | 2/69 |
| 5,792,034 | A | | 8/1998 | Kozlovsky | 482/124 |
| 5,819,322 | A | * | 10/1998 | Dicker et al. | 2/456 |
| 5,820,534 | A | | 10/1998 | Vadher | 482/124 |
| 5,957,873 | A | | 9/1999 | Allen | 602/19 |
| 6,086,551 | A | | 7/2000 | Allen | 602/19 |
| 6,213,922 | B1 | | 4/2001 | Afanasenko et al. | 482/124 |
| 6,287,242 | B1 | * | 9/2001 | Fray | 482/121 |

OTHER PUBLICATIONS

Official Bullitin Industrial Designs Russian Agency For Patents / And TradeMarks Aug. 30, 2001 REG> No. 52341.*

"Report of Adeli Suit Pilot Testing in the United States", Victor S. Koscheyev, M.D., Ph.D., Sc.D. and Gloria R. Leon, Ph.D., University of MN, Minneapolis, MN, Division of Kinesiology; Dept. of Psychology.

* cited by examiner

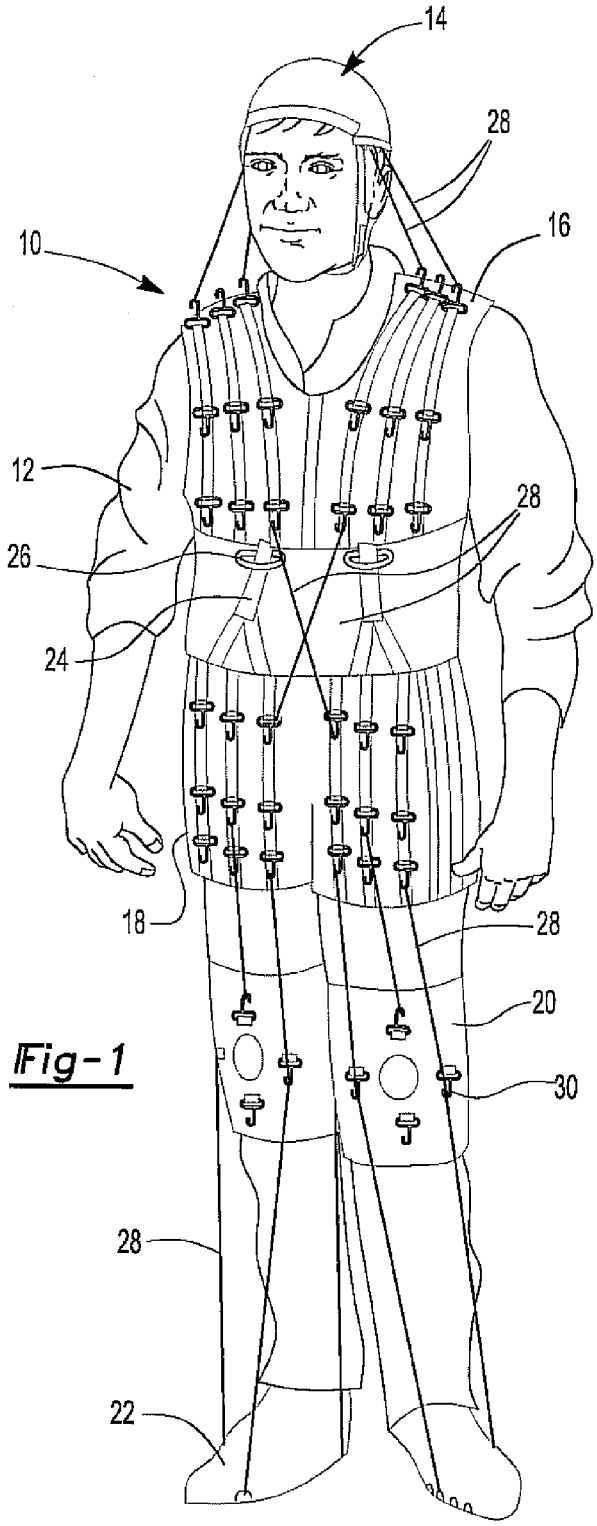
Fig-1
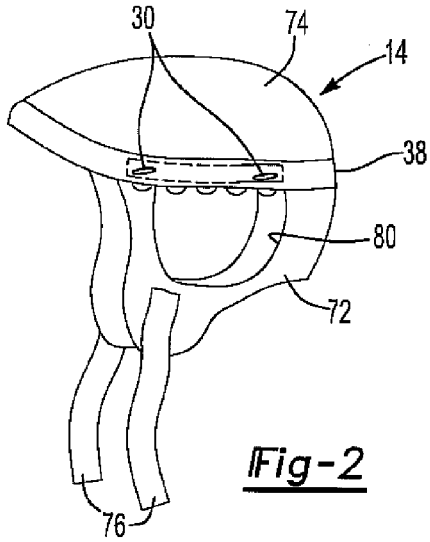
Fig-2
Fig-3
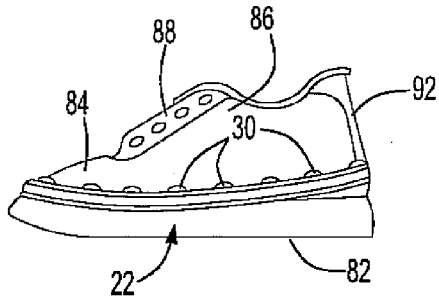

NEUROLOGICAL MOTOR THERAPY SUIT

RELATED APPLICATION

This patent application claims priority of provisional patent application Ser. No. 60/337,657 filed Nov. 13, 2001, and entitled "Soft Dynamic Body Orthotics."

BACKGROUND OF THE INVENTION

I. Field of the Invention

The present invention relates to a neurological motor therapy suit.

II. Description of the Related Art

Many individuals, such as those inflicted with infantile cerebral paralysis, suffer from neurological damage. As such, these patients are unable to control their muscles to effect normal movements.

In an effort to "train" both the muscles and the brain of the patient suffering from neurological damage, there have been previously known neurological therapy suits such as that described in U.S. Pat. No. 6,213,922 to Afanasenko et al. In the Afanasenko et al. patent, a pair of shoulder pads are secured to the patient as well as a waistband, knee supports and shoe supports. Elastic bands then extend between the shoulder pads and waistband, as well as between the waistband and the knee supports. These elastic bands are tensioned in an amount designed to simulate the proper posture for the patient. Hopefully, by forcing the patient to assume the proper posture as well as muscle movements over an hour or two, the brain will be trained to simulate such movements once the therapy suit is removed.

These previously known neurological therapy suits, however, have not proven entirely satisfactory in use. One disadvantage of these previously known therapy suits is that the position of both the shoulder pads as well as the waistband shift during movement of the patient. Such shifting of the shoulder pads and/or waistband necessarily changes the tension of elastic bands between the various components of the therapy suit. This, in turn, varies the neurological feedback signal from the muscle to the brain and results in improper muscle training for the patient.

SUMMARY OF THE PRESENT INVENTION

The present invention provides a neurological therapy suit which overcomes all of the above-mentioned disadvantages of the previously known neurological therapy suits.

In brief, the therapy suit of the present invention comprises a vest which is removably secured around the shoulders and chest of the patient. The vest completely encircles a portion of the upper torso of the patient and is constructed of a substantially non-elastic material. When properly placing on the patient, the vest snugly encircles a portion of the upper torso of the patient thus minimizing movement of the vest relative to the patient.

The therapy suit further includes a pant garment which is also detachably secured to the patient. The pant garment extends around both the hips of the patient as well as the upper portion of each thigh of the patient. The pant garment is also constructed of a substantially non-elastic material so that, with the pant garment secured to the patient, the pant garment snugly encircles the hips of the patient and minimizes or completely eliminates any movement of the pant garment relative to the patient.

The therapy suit also optionally includes both a cap which is secured across the head of the patient, knee supports which are secured around the knees of the patient, as well as shoe supports secured to the feet of the patient.

With the therapy suit secured to the patient in the previously described fashion, one or more elastic bands extend between the vest and the pant garment so that the elastic bands are in a state of tension. Furthermore, the actual tension of the elastic bands are individually adjustable so that, by properly adjusting the tension of the elastic bands, the patient's posture as well as muscle movements can be corrected to a normal or near-normal condition. Similarly, elastic bands extend between the knee supports and the pant garment, as well as between the knee supports and shoe supports. Optionally, elastic bands extend between the vest and the cap such that the patient's head, if necessary, is maintained in an upright position.

Since the vest and pant garment are snugly secured to the patient, the tension of the elastic bands attach to both the pant garment, and the vest remains constant so that the brain receives a constant neurological feedback from the muscles of the proper posture and/or muscle movements for the patient.

BRIEF DESCRIPTION OF THE DRAWING

A better understanding of the present invention will be had upon reference to the following detailed description when read in conjunction with the accompanied drawing, wherein like referenced characters refer to like parts throughout the several views, and in which:

FIG. 1 is a front elevational view illustrating a preferred embodiment of a therapy suit of the present invention worn by a patient;

FIG. 2 is a side view illustrating a preferred embodiment of the cap of the present invention;

FIG. 3 is a side view of a preferred embodiment of a shoe support of the present invention;

DETAILED DESCRIPTION OF A PREFERRED EMBODIMENT OF THE INVENTION

With reference first to FIG. 1, a preferred embodiment of the neurological therapy suit 10 of the present invention is there shown attached to a patient 12. The therapy suit 10 includes a vest 16 and pant garment 18.

Figure 4:
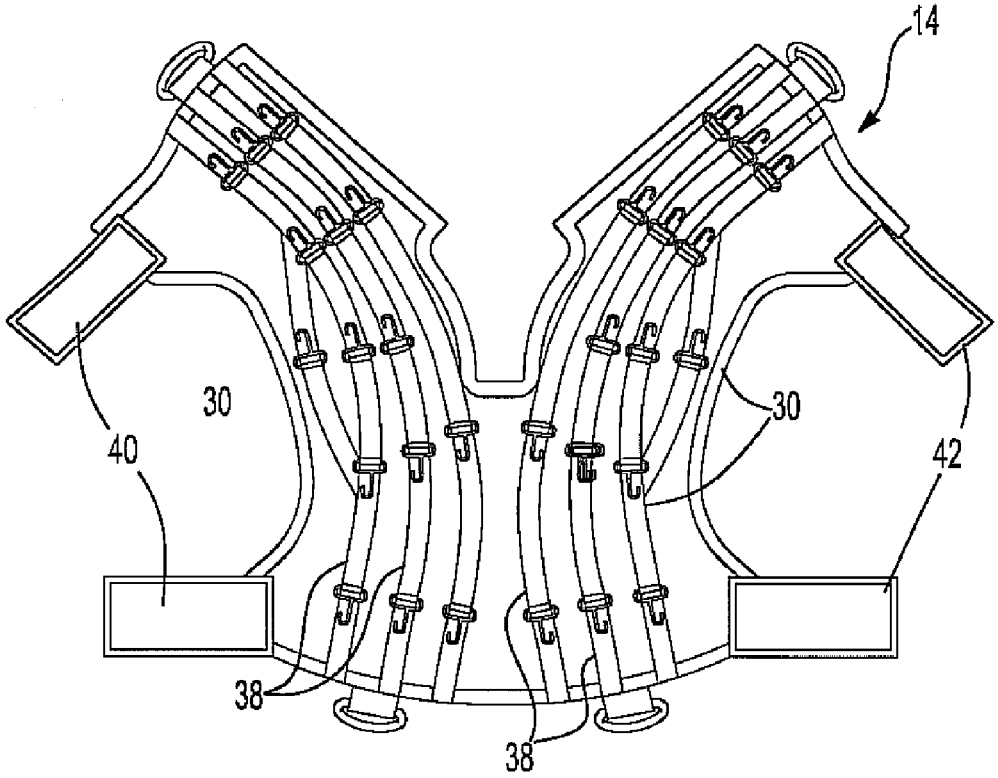
FIG. 4 is a planar view of the vest of the preferred embodiment of the present invention.

With reference now particularly to FIGS. 1 and 4, the vest 14 is there shown in greater detail and includes fasteners, such as hook-and-pile fasteners 40 on one side, and similar fasteners 42 on the opposite side so that, with the vest 16 positioned on the patient as shown in FIG. 1, the fasteners 40 are detachably secured to each other below one arm of the patient while, similarly, the fasteners 42 are detachably secured to each other around the other arm of the patient. The vest 16, furthermore, is constructed of a flexible, but substantially non-elastic material. Consequently, when the vest is secured to the patient, the vest 16 is snugly secured to the patient thus minimizing or eliminating movement of the vest relative to the patient.

As best shown in FIG. 4, the vest also includes a plurality of attachment strips 38 extending generally vertically along both the front and back of the vest 16 and so that the attachment strips 38 are laterally spaced from each other. Additionally, a plurality of longitudinally spaced attachment members 30, such as hooks, are secured to each attachment strip 38.

Figure 6:
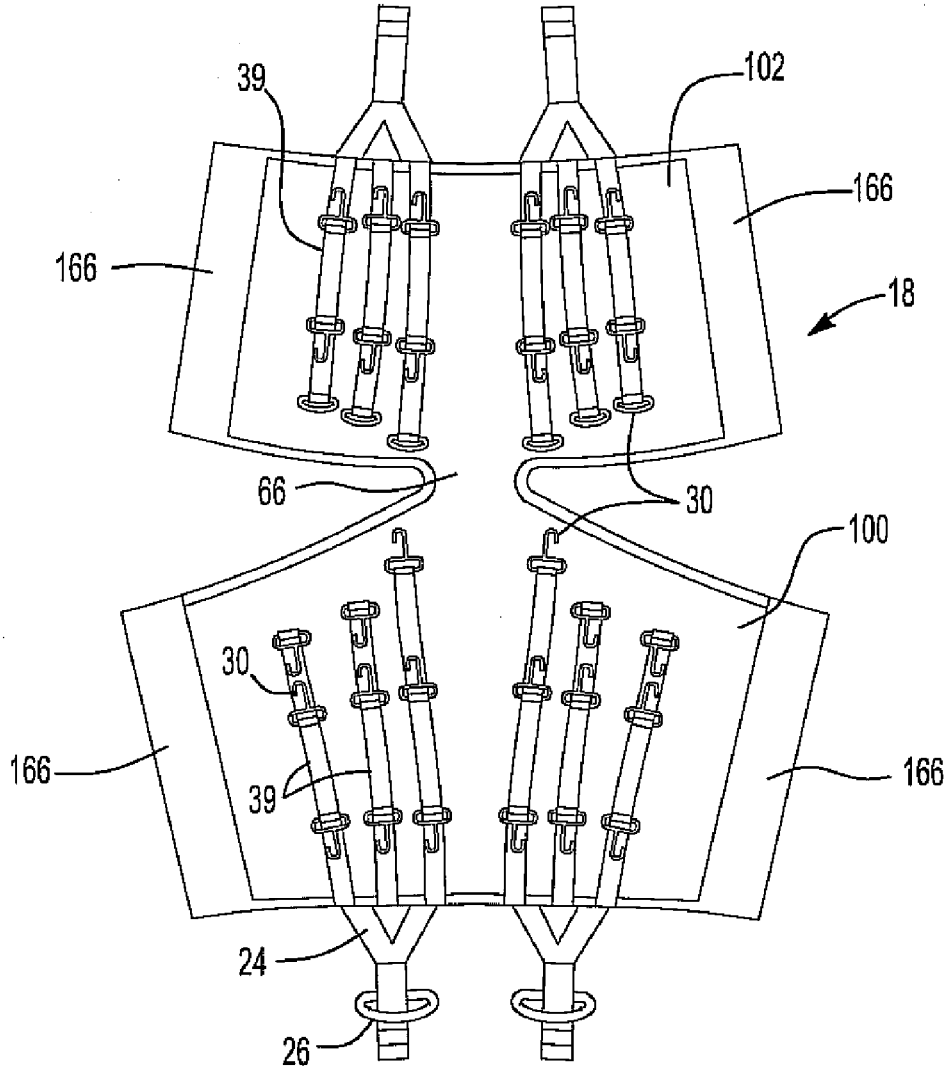
FIG. 6 is a planar view of the pant garment of the preferred embodiment of the present invention.

With reference now particularly to FIGS. 1 and 6, the pant garment 18 is there shown in greater detail and includes both a front panel 100 and a rear panel 102 which are secured together by a crotch section 66. An attachment strip 166, such as the loop-and-pile fastener, is provided along each side of both the front panel 100 and rear panel 102. Thus, with the pant garment 18 positioned on the patient, the attachment strip 166 along one side of the front panel 100 is attachably secured to its corresponding attachment strip 166 on the rear panel 102 and, likewise, the attachment strips 166 on the front panel 100 and rear panel 102 are likewise attached together. In doing so, the pant garment 18 is snugly, but detachably, secured to the patient. Furthermore, the pant garment 18, like the vest 16, is constructed of a flexible, but non-elastic, material so that, once the pant garment 18 is secured to the patient 12, movement of the pant garment 18 relative to the patient is precluded.

Still referring to FIGS. 1 and 6, the pant garment 18 also includes a plurality of vertically extending and laterally spaced attachment strips 39. Each strip includes a plurality of longitudinally spaced attachment members 30.

The pant garment 16 also preferably includes a pair of loops 26 along the upper edge of both the front panel 100 and rear panel 102. These hoops 26 may optionally be secured to the vest 16 by attachment straps 24 (FIG. 1) secured to the vest 16.

Figure 7:
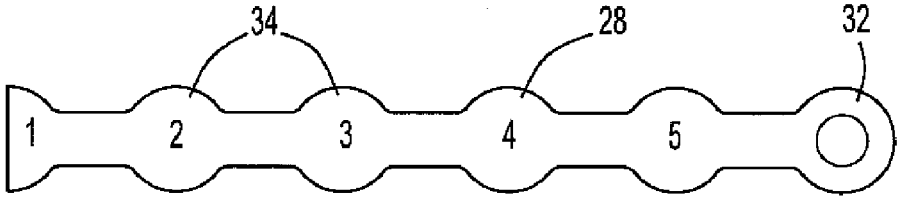
FIG. 7 is a planar view of one elastic band in the preferred embodiment of the present invention.

With reference now to FIGS. 1 and 7, the therapy suit 10 further includes a plurality of elastic bands 28, one of which is shown in FIG. 7. Each elastic band has one end 32 secured to one of the attachment members 30 on either the vest 16 or the pant garment 18. Each elastic band 28 preferably includes a plurality of longitudinally spaced adjustment nodes 34 which can be selectively secured to and retained by one of the attachment members 30 on either the vest 16 or pant garment 18.

The multiple attachment members 30 on both the vest 16 and pant garment 18, together with the adjustable elastic bands 28, allows the vest 16 to be adjustably secured under tension to the pant garment 18 with a wide range of variability. Consequently, by varying not only the number of bands 28, but also their attachment points between the vest 16 and pant garment 18, the posture of the patient 12 can be easily and accurately adjusted.

With reference now to FIGS. 1 and 2, the therapy suit 10 preferably includes a cap 14 having a crown portion 74 with an encircling band 38 around its outer periphery. Thus, with the cap 14 positioned on the patient's head as shown in FIG. 1, the crown 74 covers the top of the patient's head while the encircling band 38 encircles the patient's head above the patient's ears.

A pair of earflaps 72 are secured to the band 38 on opposite sides of the crown 74 so that the earflaps 72 extend over the ears of the patient 12. These earflaps 72, furthermore, are detachably secured to the patient 12 by fastening strips 76, such as hook-and-pile fasteners, which extend under the patient's chin to snugly secure the cap 14 to the patient 12 and eliminate any movement of the cap 14 relative to the patient's head.

The earflaps 72 also preferably include an opening 80 which is aligned with the patient's ear. The opening 80 not only allows the patient to hear normal sounds, but is also preferably sufficiently large to allow the passage of an intravenous tube if necessary.

At least one, and preferably two, attachment members 30 are secured to the band 38 above each earflap 72. One or more elastic bands 28 (FIG. 7) are then secured under tension between the attachment members 30 on the cap 14 and the attachment members 30 on the vest 16. These elastic bands 28 are tensioned in a variable amount necessary to maintain the patient's head in a normal, erect position.

Figure 5:
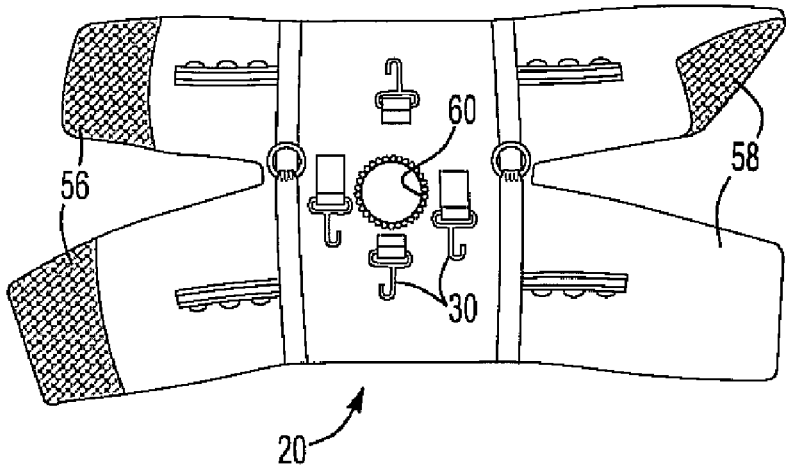
FIG. 5 is a planar view of a knee support of the preferred embodiment of the present invention.

With reference now to FIGS. 1 and 5, a knee support 20 is optionally secured around each knee of the patient 12. Each knee support 20 is constructed from a flexible, but non-elastic, material and includes an opening 60 which is aligned with the patient's kneecap. Fasteners 56 on one side of the knee support 20 are detachably secured with fasteners 58 on the opposite side of the knee support 20 so that the knee support 20 encircles the patient's knees. The fasteners 56 and 58, preferably hook-and-pile fasteners, allow the knee support 20 to be snugly secured around the patient's knees and eliminate movement of the knee support 20 relative to the patient's knees.

A plurality of fasteners 30 are also secured to the knee support 20 so that the fasteners 30 are positioned in front of the patient's knees. One or more elastic bands 28 (FIG. 7) are then connected under the desired variable tension to fasteners 30 on the pant garment 18.

With reference now to FIGS. 1 and 3, a shoe support 22 is optionally mounted to each foot of the patient 12. This shoe support 22 includes a flap and generally rigid sole support 82 which extends under the user's feet. A toe band 84 has each end secured to the sole 82 so that the toe support 82 extends across the top of the patient's foot adjacent the patient's toes. Similarly, a heel support 92 is secured to the sole 82 such that the heel support 92 extends around the patient's heel. An ankle strap 86 then extends around the patient's foot adjacent the patient's ankle and is snugly secured to the patient by a fastener 88, such as a hook-and-pile fastener, shoelaces, or any conventional fastening means. Thus, with the shoe support 22 secured to the patient's foot, movement of the shoe support 22 relative to the patient's foot is precluded.

A plurality of attachment members 30 are secured to the shoe support. Preferably, the fasteners 30 are secured to both the toe band 84 as well as to the heel support 92. Elastic bands 28 (FIGS. 1 and 7) are then secured between the attachment members 30 on the shoe support 22 and the attachment members 30 on the knee support 20 to provide the desired neurological feedback during normal movement of the patient 12.

In practice, since the components, i.e. the cap 14, vest 16, pant garment 18, knee supports 20 and foot supports 22, are snugly secured to the patient 12, the neurological therapy suit 14 provides stabilization for the patient. The elastic bands extending between the various components of the therapy suit are widely adjustable both through the tension provided by the elastic bands as well as the position of attachment of elastic bands on the various components to thereby achieve the desired posture and/or neurological feedback during normal muscle movement of the patient. Unlike the previously known therapy suits, since all of the components of the therapy suit 10 of the present invention are snugly secured to the patient, movement of these components of the therapy suit, and the resulting variation of tension of the attached elastic bands 28, is completely eliminated.

Having described my invention, it can therefore be seen that the therapy suit of the present invention provides a neurological therapy suit that can be simply and easily attached to and removed from the patient. Furthermore, the therapy suit of the present invention advantageously trains the brain of those suffering from neurological disorders of both proper posture as well as proper muscle movement. Having described my invention, however, many modifications thereto will become apparent to those skilled in the art to which it pertains without deviation from the spirit of the invention as defined by the scope of the appended claims.

We claim:

1. A neurological motor therapy suit comprising:

a vest removably secured around the shoulders and chest of a patient, said vest completely encircling a portion of an upper torso of the patient, said vest being constructed of a substantially non-elastic material, a pant garment detachably secured to the patient so that the pant garment extends around both the hips of the patient as well as an upper portion of each right thigh of the patient, said pant garment being constructed of a substantially non-elastic material, a plurality of elastic bands extending between and interconnecting said vest and said pant garment, and a pair of knee supports, a plurality of elastic bands extending between said interconnecting said pant garment and said knee supports, wherein said vest comprises a back panel, a front left panel and a front right panel, said vest having side portions and shoulder portions separated by an arm hole which side portions and said shoulder portions integrally join said back panel to said front left panel and said front right panel, and a first hook-and-loop fastener which detachably secures said front right panel to said back panel below one said arm hole together and a second hook-and-loop fastener which secures said front left panel to said back panel below the other said arm hole together.

2. The invention as defined in claim 1 and comprising a cap removably secured to the head of the patient, and a plurality of elastic bands between and interconnecting said cap and said vest.

3. The invention as defined in claim 2 wherein said cap is constructed of a non-elastic material.

4. The invention as defined in claim 1 and comprising a pair of shoe supports, one shoe support being attached to each foot of the patient, and a plurality of elastic bands extending between and interconnecting said knee supports and said shoe supports.

* * * * *